United States Patent [19]

Ohta

[11] Patent Number: 4,860,390

[45] Date of Patent: Aug. 29, 1989

[54] DRAINAGE PLUG

[76] Inventor: Ikumi Ohta, 2800-31, Oaza Nao, Asahi-cho, Mie-gun, Mie-ken, Japan

[21] Appl. No.: 169,422

[22] Filed: Mar. 17, 1988

[30] Foreign Application Priority Data

Mar. 31, 1987 [JP] Japan ..... 62-49646[U]

[51] Int. Cl.[4] ..... F16K 31/44

[52] U.S. Cl. ..... 4/295; 4/287

[58] Field of Search ..... 4/203, 204, 295, 287

[56] References Cited

U.S. PATENT DOCUMENTS

| | | | |
|---|---|---|---|
| 1,246,737 | 11/1917 | Frickie | 4/204 |
| 3,333,815 | 8/1967 | Downey et al. | 4/295 X |
| 3,366,980 | 2/1968 | Petursson et al. | 4/295 |
| 3,428,295 | 2/1969 | Downey et al. | 4/295 X |
| 3,468,512 | 9/1969 | Politz | 4/295 X |
| 4,007,500 | 2/1977 | Thompson et al. | 4/295 |
| 4,276,662 | 7/1981 | Young | 4/287 X |
| 4,596,057 | 6/1986 | Ohta et al. | 4/203 |

*Primary Examiner*—Chris K. Moore

*Attorney, Agent, or Firm*—Sandler & Greenblum

[57] ABSTRACT

A drainage plug to be used in a bathtub, a basin or the like, wherein the plug is provided with a mechanism for opening or closing a plug cap every time a direct contact of a user with the plug cap through a user's foot or hand is performed. A foot or manual depressing action is applied and a depressing of the plug cap opens or closes the plug.

13 Claims, 5 Drawing Sheets

DRAINAGE PLUG

BACKGROUND OF THE INVENTION

1. Field of the Invention

This invention relates to a drainage plug to be used in a bathtub, a basin and the like.

2. Description of the Background and Pertinent Information

A prior art drainage plug is constructed such that a guide cylinder is fixed at a central part of a drainage port in a main body of the drainage plug, a supporting shaft is fitted within the guide cylinder in such a way that it may be moved up or down in the vertical direction, a plug cap for opening or closing the drainage port is arranged at the upper end of the supporting shaft and a thrust lock mechanism is installed within the guide cylinder.

The thrust lock mechanism may lock the supporting shaft at one end of a retracting path when the supporting shaft that is fitted in the guide cylinder is continuously advanced or retracted. This prior art drainage plug is constructed such that the guide cylinder has a thrust mechanism installed therein that is held at the central part in the drainage port with the end of the supporting shaft facing upward to the lock side. The plug cap is installed at the upper end of the supporting shaft.

Therefore, the plug cap is pulled up and locked to open the drainage port. When the lock is released, the plug cap may drop by its own weight to close the drainage port.

In order to move the plug cap up or down (for its opening or closing) in the drainage port, a chain or the like fixed to the upper surface of the plug cap is pulled up. However, a grasping and pulling up of the chain or the like every time the plug cap is to be opened or closed is a troublesome operation and fixing the chain or the like to the plug cap is quite troublesome.

A remotely operated system having no such chains as described above is disclosed in U.S. Pat. No. 4,596,057.

However, in such a remote controlled or operated system, it is necessary to provide accessory members such as a wire-like body, a guide tube and a connecting member or the like. It is also necessary to install these members and these requirements cause the system to be expensive.

SUMMARY OF THE INVENTION

It is an object of the present invention to enable the plug cap to be opened or closed and to simplify this operation by a method wherein a user may directly touch the plug cap by depressing a foot (in case of an application for a bathtub) or a manual depressing (in case of an application for a basin) so as to eliminate the above-described disadvantages.

It is another object of the present invention to eliminate accessory members to be used in a remotely operated system and provide a less expensive drainage plug having a simple structure.

This invention relates to a drainage plug in which a supporting shaft for supporting a plug cap is fitted in a guide cylinder in such a way that it may be axially advanced or retracted, the supporting shaft being locked at one end of an advancing or retreating path when the supporting shaft is continuously advanced or retracted, a thrust lock mechanism for repeating a lock releasing action alternatively being arranged within the guide cylinder, the guide cylinder being held at a central part of a drainage port with the lock end of the support shaft being located below and a spring for always biasing the supporting shaft upwardly being arranged thereon, and a plug cap being attached to the upper end of the support shaft.

According to the present invention, as the plug cap is depressed downwardly against the biasing force of a spring, the supporting shaft is retracted together with the plug cap and locked at its lower end under an action of the thrust lock mechanism. With this arrangement, the plug cap is held while the drainage port is closed.

Further, as the opened or closed plug cap is further depressed downwardly, a packing at the lower surface of the cap plate is compressed, the thrust lock is operated to release the locked condition of the supporting shaft, and the plug cap is lifted up with a biasing force of the spring to cause the plug to be opened.

DESCRIPTION OF THE PREFERRED EMBODIMENTS

Figure 1:
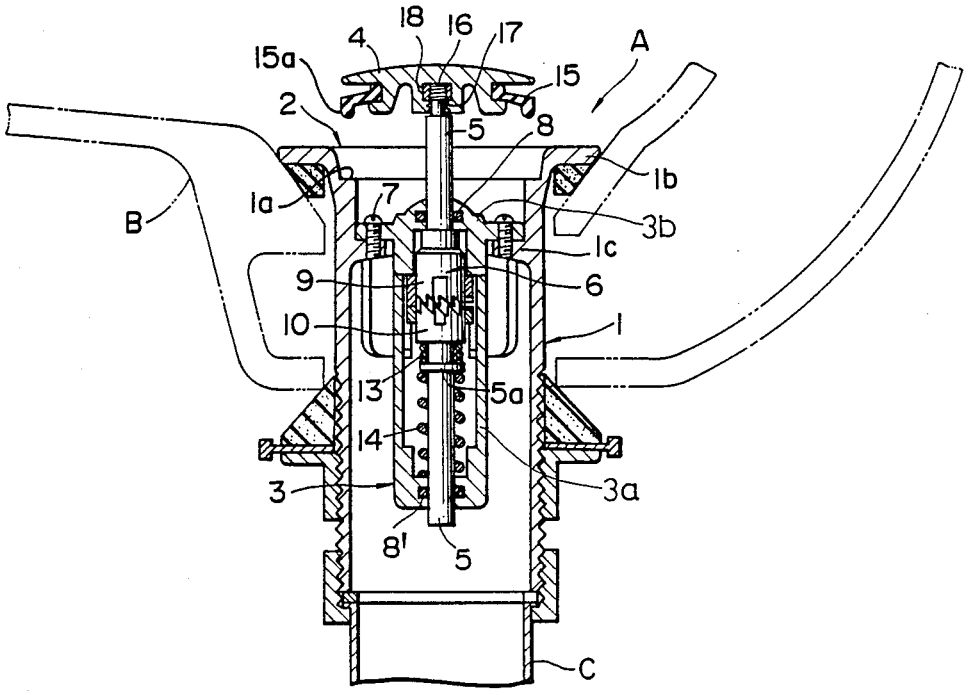
FIG. 1 is a longitudinal section showing a drainage plug in the opened condition.

The drawings illustrate a drainage plug (A) installed in a reservoir tank (B) of a basin. The drainage plug (A) is constructed such that a guide cylinder (3) is arranged in a drainage port (2) of a main body (1) of the drainage plug that is fitted in a bottom part of the reservoir tank (B). A supporting shaft (5) supporting a plug cap (4) is fitted in a guide cylinder (3) in such a way that it may be advanced or retracted in its upward or downward direction, and the supporting shaft (5) is engaged with a thrust lock mechanism (6) arranged in the guide cylinder (3). The main body (1) of the drainage plug is a cylindrical body formed with a concave part (1*a*) and a flange part (1*b*) at its upper edge. The main body is inserted from above to a fixing port in the reservoir tank (B), and a drainage pipe (C) is connected to the lower end thereof.

Fixing pieces (1*c*) and (1*c*) project toward the center of the drainage port (2) from an inner circumferential surface of the drainage port (2) of the main body (1). The guide cylinder (3) is bolted at (7) to the fixing pieces (1*c*) and (1*c*) so that the guide cylinder (3) is vertically held in the central part of the drainage port (2).

The guide cylinder (3) is comprised of a main body (3*a* ) of the guide cylinder and a cap (3*b* that is fixed to the fixing pieces (1*c*) and (1*c*). The supporting shaft (5) is inserted in the central part of the cylinder so that it may slide in upward or downward directions. Packings (8) and (8') are fitted in upper and lower fitting portions at both ends forming a sealed condition. The supporting shaft (5) and thrust lock mechanism (6) are assembled within the cylinder (3) so as to connect the main body (3*a*) of the cylinder to the cap body (3*b*).

Figure 2:
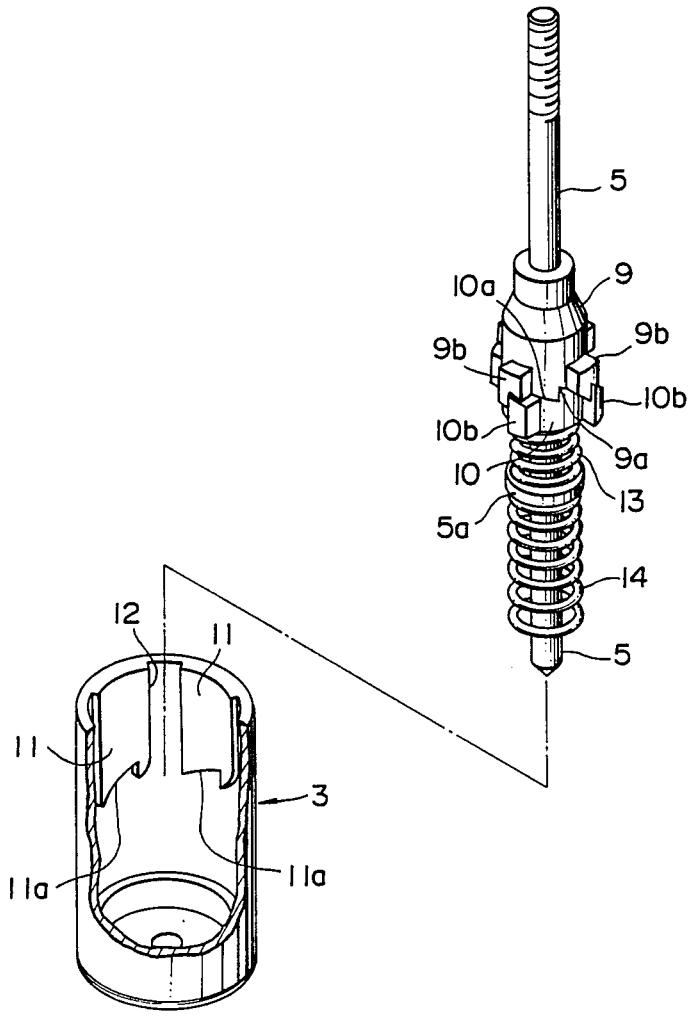
FIG. 2 is a perspective view, partly broken away, of the thrust lock mechanism.

As shown in FIG. 2, the thrust lock mechanism (6) is a mechanism such as used for retracting or extending a pen core such as in a ball point pen or the like. It is composed of a fixing ring (9) fitted to the upper part of the supporting shaft (5) and arranged on the supporting shaft below the fixing ring is a rotary ring (10) in such a way that it may be rotated and slid in its upward or downward direction, engaging projections (11) and guide grooves (12) formed in the guide cylinder.

The fixing ring (9) is formed with saw teeth (9*a*) at its lower edge and fitting claws (9*b*) spaced apart by 90° around a circumferential surface thereof. The lower surfaces of the fitting claws (9*b*) are similarly inclined as those of the saw teeth (9*a*).

The rotary ring (10) is formed with saw teeth (10*a*) at its upper end to be engaged with the saw teeth (9*a*) of the fixing ring. Engaging claws (10*b*) which are inclined in the same manner as the saw teeth (10*a*) are formed at the upper surface around the circumferential surface and are spaced 90° apart from each other. A spring (13) is placed between a spring seat (5*a*) that is fixed substantially at a central part of the supporting shaft (5) and the rotary ring (10) and thereby always pushes the saw teeth (10*a*) of the rotary ring (10) against the saw teeth (9*a*) of the fixing ring (9) under constant pressure.

The inner circumferential surface of the guide cylinder (3) is formed with guide grooves (12) spaced 90° apart from each other into which the fitting claws (9*b*) of the fixing ring (9) are fitted between the engaging projections (11). The lower edge of each of the engaging projections (11) is formed with inclined sides (11*a*) for receiving the engaging claws (10*b*) of the rotary ring (10).

The supporting shaft (5) is fitted in the guide cylinder (3) while the fitting claws (9*b*) of the fixing ring (9) are fitted in the guide grooves (12), thereby restricting rotation and is supported in such a way as it may slide in an upward or downward direction. At the same time, it is always biased upwardly by the spring (14) that is arranged between the spring seat (5*a*) and the bottom surface of the guide cylinder (3) in its compressed condition and is stopped at its upper end position where the upper end of the fixing ring (9) is pressed against the lower surface of the cap body (3*b*).

The plug cap 4 is threaded to the upper end of the supporting shaft (5). A packing (15) is fitted to an outer circumference of a lower surface of the plug cap (4), and the plug is closed when the packing (15) and the plug cap (4) are fitted in the concave part (1*a*) of the drainage plug main body (1). Packing 15 includes a convex-shaped ring portion (15*a*) that contacts concave part (1*a*) without sliding relative thereto. The supporting shaft (5) and the plug cap (4) are fixed by a threaded part (16) located at a specified portion of the upper end of the supporting shaft (5). A fitting part (18) having a threaded hole (17) only a its inlet part is arranged at a rear central surface of the plug cap (4). The threaded part (16) of the support shaft (5) is threadably engaged with the threaded hole (17), and is thereafter fitted to the fitting part (18). With this arrangement, the supporting shaft can freely rotate with respect to the plug cap as to prevent removal of the plug cap (4).

Figure 3:
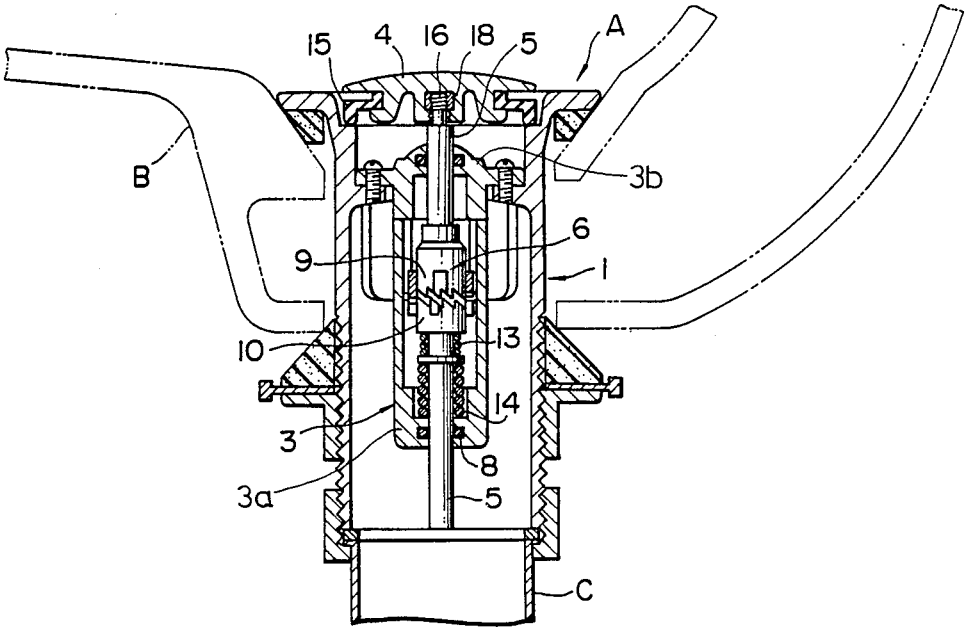
FIG. 3 is a longitudinal section showing the closed condition of a drainage plug.
Figure 4:
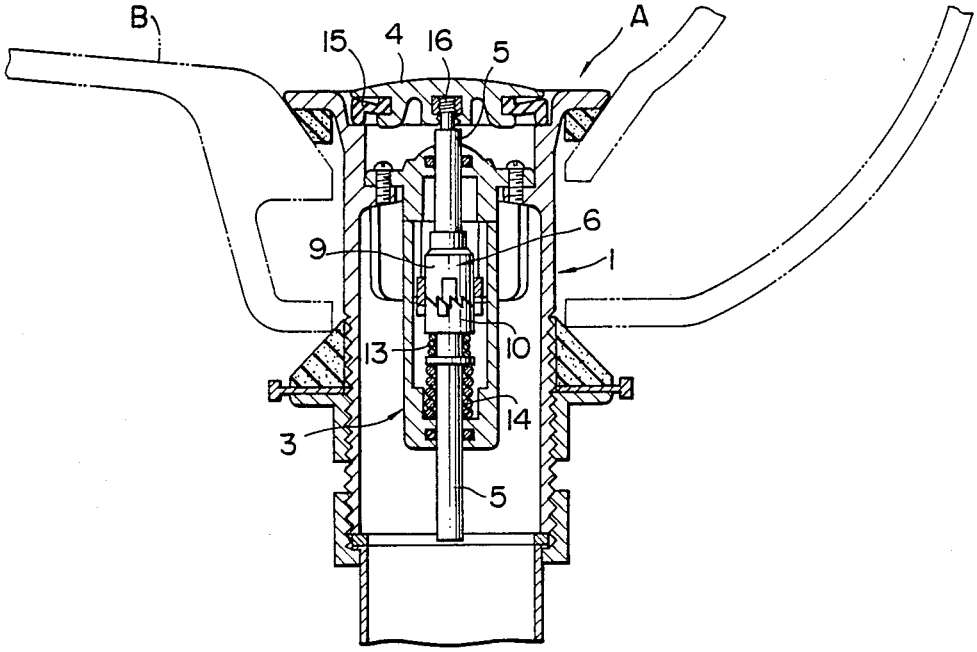
FIG. 4 is a longitudinal section showing the condition in which the plug cap of the drainage plug is depressed down to its lowermost end.

The packing (15) is formed in such a manner that its outer circumference depends downwardly so that it can be sufficiently compressed and thereby the plug cap (4) can be depressed from its closed condition shown in FIG. 3 to the condition shown in FIG. 4.

Furthermore, the operation of the thrust lock mechanism and the plug opening and closing operation will be described in reference to FIGS. 5(A) to (D).

Figure 5A:
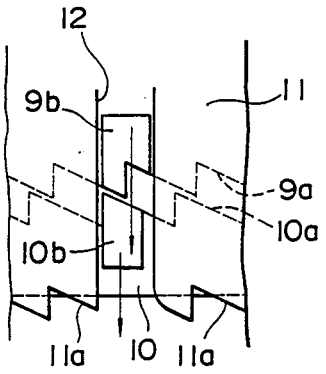
FIG. 5(A) to (D) are schematic views showing the operation of the thrust lock mechanism.

FIGS. 5(A) to (D) illustrate a schematic view in which a surrounding part of the guide grooves (12) of the guide cylinder (3) is illustrated from its outer circumference. FIG. 5(A) shows the part of the guide groove (12) when the plug is opened as shown in FIG. 1. In this condition, the fitting claw (9*b*) of the fixing ring (9) is positioned at an upper end of guide groove (12), the engaging claw (10*b*) or the rotary ring (10) is fitted in the guide groove (12) and abutted against the lower surface of the fitting claw (9*b*). Under this condition, the saw teeth (9*a*) of the fixing ring (9) and the saw teeth (10*a*) of the rotary ring (10) are engaged with each other while the end portions of both teeth abut each other.

Figure 5B:
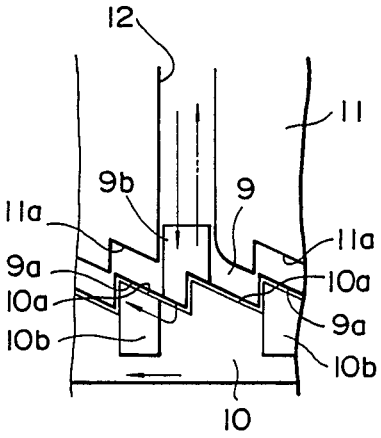

Then, as the plug cap (4) is depressed down to a position shown in FIG. 4, the fitting claw (9*b*) of the fixing ring (9) descends down to a lower end of the guide groove (12) to push out the engaging claw (9*b*) of the fixing ring (9) from the lower end of the guide groove (12). Then, the saw teeth (10*b*) of the rotary ring (10) slide along the inclined surface of the saw teeth (9*b*) of the fixing ring (9) in a leftward direction with the biasing force of the spring (13) and thus both saw teeth (9*b*) and (10*b*) completely engage each other as shown at FIG. 5(B).

Figure 5C:
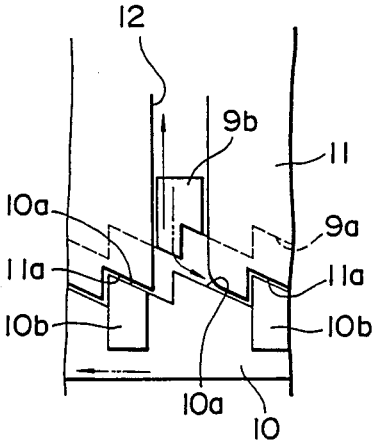

When a hand is released from the plug cap (4) that is depressed down to a condition shown in FIG. 4, the supporting shaft (5) lifts under the force of the spring (14), and the rotary ring (10) is pushed up by the spring seat (5*a*), thereby as shown in FIG. 5(C), the engaging claw (10*b*) of the rotary ring (10) is engaged with the inclined side (11a) at the lower edge of the engaging projection (11) of the guide cylinder (3).

Therefore, the engaging claw (10*b*) of the rotary ring (10) is engaged with the inclined side (11*a*) at the lower edge of the engaging projection (11), thereby locking the supporting shaft (5) at its lower end and the plug cap (4) is also locked in its closed condition as shown in FIG. 3.

Figure 5D:
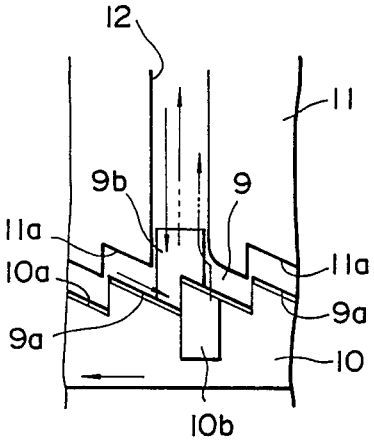

Then, if the plug cap (4) under its closed condition is depressed down to a position shown in FIG. 4, saw teeth (9*a*) of the fixing ring (9) depress the end part of the saw teeth (10*a*) to cause the engaging claw (10*b*) of the rotary ring (10) engaged with the inclined side (11*a*) to be disengaged downwardly. Then, the saw teeth (10*a*) of the rotary ring (10) slide in a leftward direction along the inclined side of the saw teeth (9*a*) of the fixing ring (9) under a biasing force of the spring (13). Then both saw teeth (9*a*) and (10*a*) are completely disengaged from each other as shown in FIG. 5(D).

Then if the plug cap (4) is released, the fitting claw (9*b*) of the fixing ring (9) may ascent within the guide groove (12). Simultaneously, the supporting shaft (5) and the rotary ring (10) are lifted up with the force of the spring (14) and after the engaging claw (10*b*) of the rotary ring (10) abuts against a lower end port of the guide groove (12), it may ascend within the guide groove (12) together with the fitting claw (9*b*) and returned back to the condition shown in FIG. 5(A).

As described above, since the drainage plug (A) can be opened or closed under a manual depression of a user of the plug cap (4) from above, the opening or closing operation can easily be performed.

Although the preferred embodiments are illustrated for a case in which the present invention is applied to a basin, the present invention can also be applied in a bathtub and in this case the plug cap is depressed down by a foot depressing action of the user.

Figure 6:
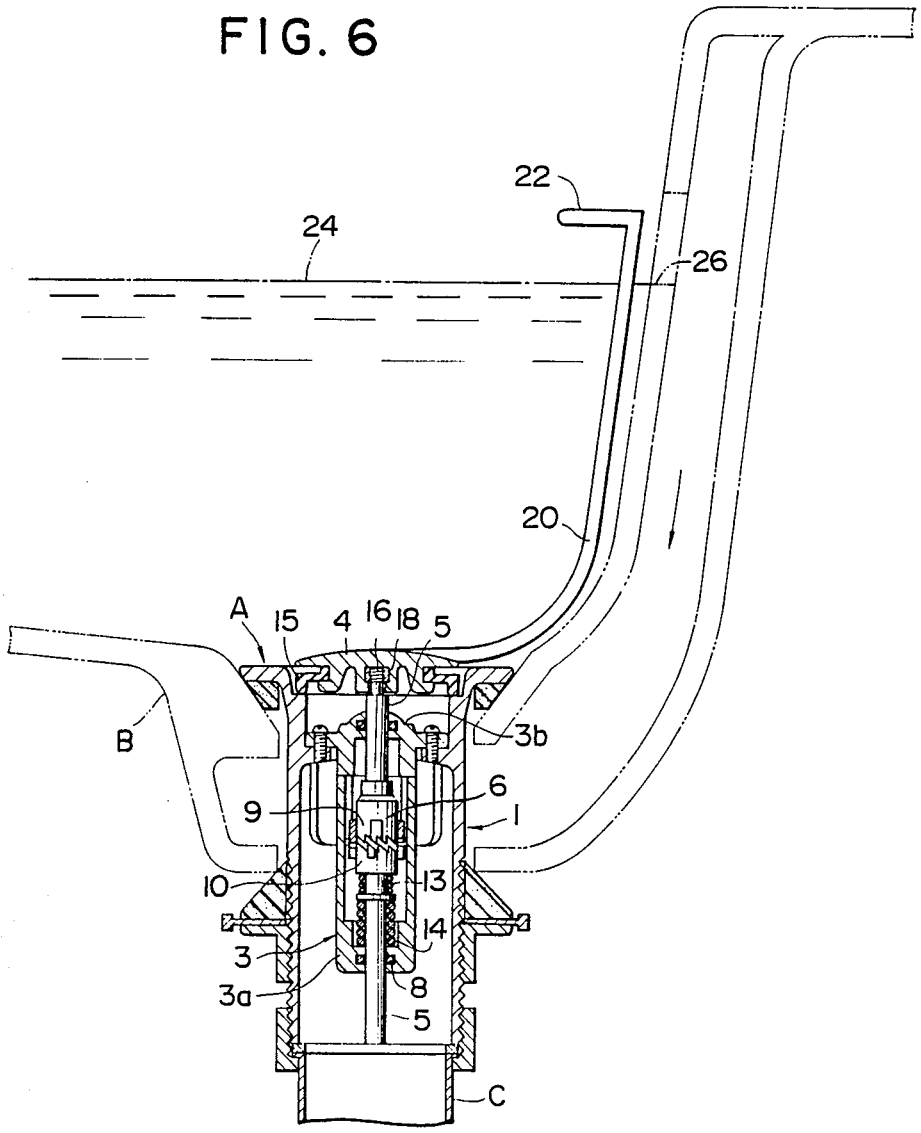
FIG. 6 is a longitudinal section showing a modified form of the present invention.
Figure 7:
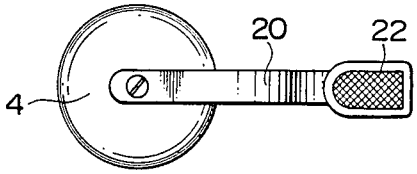
FIG. 7 is a top plan view showing the plug cap and an operating member shown in FIG. 6.

FIGS. 6 and 7 illustrate another preferred embodiment of the present invention in which an operating lever (20) is connected to the plug cap (4).

In this preferred embodiment, the lower end of the operating lever (2) is connected to the plug cap (4) by a screw or the like or the plug cap (4) and the operating lever (20) can be integrally formed. A pressing surface (22) is formed at the upper end of the operating lever (20).

The operating lever (20) is rigid and is made by a material having a small as possible deformation and strain caused by its depressing action. For example, the material may be either a hard resin or a light metallic material.

The pushing surface (22) projects upwardly from the surface (24) of the accumulated water in the reservoir (B).

In order to perform this operation, the pushing surface (22) may be arranged either at the same level or at a higher level than that of the overflow port (26) of the reservoir (B).

The operating lever (20) is preferably formed as an upwardly curved shape along an inner circumferential surface near the drainage port (2) of the reservoir (B), thereby preventing the operating lever (20) from being disturbed during use of water in the reservoir (B).

In this way, in case that the accumulated water in the reservoir (B) is to be discharged, the pushing surface (22) of the operating lever (20) is manually pushed down causing the plug cap (4) to descend, enabling the abovementioned plug opening operation to be performed.

Therefore, the cap can be opened without inserting the hand of the operator into the reservoir and the water can be discharged.

What is claimed is:

1. A drainage plug for opening and closing a drainage port in a reservoir, comprising:

a guide cylinder located at a central part of the drainage port;

a supporting shaft slidably fitted into said guide cylinder so that said supporting shaft may axially slide along an advancing or retracting path with respect to said guide cylinder;

a plug cap supported on the upper end of the supporting shaft;

a first spring for biasing the supporting shaft in an upward direction, whereby the plug cap can be moved downwardly when the drainage plug is closed;

a thrust lock mechanism within the guide cylinder for locking and releasing the supporting shaft at one end of the advancing or retracting path, the thrust lock mechanism includes a fixing ring connected to said supporting shaft and a rotary ring arranged to slidably and rotatably move with respect to said supporting shaft, and a second spring for biasing the rotary ring in an upward direction.

2. A drainage plug as set forth in claim 1, and further comprising a depressable packing connected to a lower surface of said plug cap, said packing being compressed to enable the plug cap to move downwardly.

3. A drainage plug as set forth in claim 2, wherein said packing includes a convex-shaped ring portion.

4. A drainage plug as set forth in claim 3, wherein said guide cylinder is attached within a main body of the drainage plug, said main body includes a drainage port at its upper end with a concave part at the upper edge, said convex-shaped ring portion of said packing ring fitting into said concave part when the drainage plug is closed.

5. A drainage plug as set forth in claim 2, wherein said guide cylinder is attached within a main body of the drainage plug, said main body includes a drainage port at its upper end with a concave part at the upper edge, said packing fitting into said concave part when the drainage plug is closed.

6. A drainage plug as set forth in claim 1, and further comprising a packing material between the supporting shaft and the guide cylinder so that the guide cylinder is sealed.

7. A drainage plug as set forth in claim 1, wherein said plug cap includes a fitting part having a hole at a rear central surface thereof, said hole of said fitting part being threaded only at the inlet portion, said supporting shaft having a threaded part at its upper end, said threaded part of said supporting shaft being fitted into the threaded inlet portion of the fitting part, and thereafter being fitted to the remainder of the fitting part, thereby allowing the supporting shaft to freely rotate with respect to the plug cap.

8. A drainage plug as set forth in claim 1, wherein said fixing ring and said rotary ring each include saw teeth positioned to engage each other.

9. A drainage plug as set forth in claim 1, wherein said guide cylinder includes engaging projections and guide grooves, said fixing ring includes fitting claws, said rotary ring includes engaging claws, said fitting claws being fitted into said guide grooves and said engaging claws being received by said engaging projections.

10. A drainage plug as set forth in claim 1, and further including an operating lever connected to said plug cap, and a pushing surface at an upper end of said lever.

11. A drainage plug as set forth in claim 10, wherein said operating lever is removably attached to said plug cap.

12. A drainage plug as set forth in claim 10, wherein said upper end of said lever is at least as high as an overflow port of the reservoir.

13. A drainage plug as set forth in claim 10, wherein said operating lever is upwardly curved so as to follow the shape of an inner surface of the reservoir.

* * * * *

UNITED STATES PATENT AND TRADEMARK OFFICE

CERTIFICATE OF CORRECTION

PATENT NO. : 4,860,390

DATED : August 29, 1989

INVENTOR(S) : Ikumi OHTA

It is certified that error appears in the above-identified patent and that said Letters Patent is hereby corrected as shown below:

Column 2, line 64, change "(3b" to ---(3b)---;
Column 3, line 60, change "a" to ---at--- after "only";
Column 4, line 14, change "or" to ---of---;
Column 4, line 59, change "ascent" to ---ascend---; and
Column 5, line 12, change "(2)" to ---(20)---.

Signed and Sealed this

Fourteenth Day of July, 1992

*Attest:*

DOUGLAS B. COMER

*Attesting Officer*

*Acting Commissioner of Patents and Trademarks*